United States Patent [19]

Hoshall

[11] 4,365,762

[45] Dec. 28, 1982

[54] MATERIAL MOVING APPARATUS

[76] Inventor: Tom C. Hoshall, 1001 Enterprise Ave., Suite 13, Oklahoma City, Okla. 73128

[21] Appl. No.: 272,663

[22] Filed: Jun. 11, 1981

Related U.S. Application Data

[63] Continuation-in-part of Ser. No. 29,642, Apr. 13, 1979, Pat. No. 4,273,296.

[51] Int. Cl.[3] ..... B02C 13/288

[52] U.S. Cl. ..... 241/60; 241/101 A; 241/189 R

[58] Field of Search ..... 406/135; 241/60, 101 A, 241/101.5, 101.6, 185 A, 186 R, 186 A, 188 R, 186.2, 189 R, 191, 195, 196, 248, 282.1, 282.2, 293, 295, 260.1, 277

[56] References Cited

U.S. PATENT DOCUMENTS 3,061,206 10/1962 Matter ..... 241/101 A X
3,529,870 9/1970 Woten ..... 406/135 X
3,556,418 1/1971 Hokana ..... 241/60
3,995,775 12/1976 Birkheimer et al. ..... 406/135 X
4,084,753 4/1978 Fruh ..... 241/188 R X

*Primary Examiner*—Mark Rosenbaum
*Attorney, Agent, or Firm*—Dunlap & Codding

[57] ABSTRACT

The present invention contemplates an improved material moving apparatus which is particularly useful for blowing insulation material into portions of various structures. The apparatus includes: a hopper, having a chamber; a hopper blade assembly; a blower assembly; and a discharge conduit. The blower assembly includes an air lock positioned about a discharge opening from the hopper, the air lock including a plurality of rotating vanes which divide the air lock into an inlet chamber communicating with the hopper and an outlet chamber through which air is blown. The material is discharged into the hopper chamber, contacted by the hopper blade assembly, and discharged from the hopper chamber into the inlet chamber of the air lock for transfer to the outlet chamber thereof for discharging the material from the material moving apparatus.

6 Claims, 4 Drawing Figures

MATERIAL MOVING APPARATUS

CROSS-REFERENCE TO RELATED APPLICATION

The present application is a continuation in part of the Applicant's co-pending U.S. Pat. application, Ser. No. 29,642, filed Apr. 13, 1979, now U.S. Pat. No. 4,273,296 and entitled "MATERIAL MOVING APPARATUS".

BACKGROUND OF THE INVENTION

Field of the Invention

The present invention relates generally to an improved material moving apparatus and, more particularly, but not by way of limitation, to an improved apparatus for blowing insulation.

DESCRIPTION OF THE PREFERRED EMBODIMENT

Figure 1:
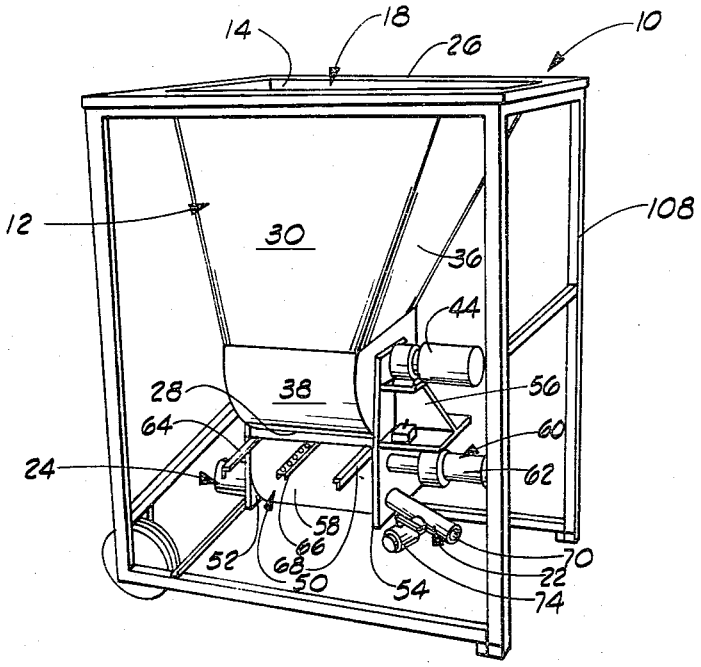
FIG. 1 is a perspective view of the material moving apparatus of the present invention.

Referring to the drawings in general and to FIG. 1 in particular, shown therein and designated via the general reference numeral 10 is a material moving apparatus constructed in accordance with the present invention. In general, the material moving apparatus 10 includes: a hopper 12, having a material receiving opening 14, a material discharge opening 16 (see FIG. 2) and a chamber 18, the material receiving and discharge openings 14 and 16, respectively, each being in communication with the chamber 18; a hopper blade assembly 20 (see FIGS. 2 and 3) which is disposed in the hopper chamber 18; a blower assembly 22 (see FIGS. 3 and 4); and a discharge conduit 24 which is connected to the blower discharge shown in FIG. 3 and designated by the numeral 23 therein. (For clarity of illustration, portions of the blower assembly 22 which would be visible through the discharge opening 16 in FIG. 2 have been deleted therefrom.)

In general, the material, such as insulation material, for example, is discharged into the chamber 18 through the material receiving opening 14. The material falls or moves through the chamber 18 generally toward the material discharge opening 16. As the material falls toward the material discharge opening 16, the material is contacted by the hopper blade assembly 20, the hopper blade assembly 20 cooperating to shred the material and move the material from the hopper chamber 18 toward and through the material discharge opening 16 for discharging the material from the chamber 18. The material discharged through the hopper material discharge opening 16 is received at the blower inlet 25 (FIG. 3) of the blower assembly 22 and forcibly discharged by the blower assembly 22 into and through the discharge conduit 24, the material being discharged from the material moving apparatus 10 via the discharge conduit 24. In a particular insulation blowing application, one end of a flexible conduit (not shown) is connected to the discharge conduit 24 for guiding the discharged material into portions of various structures.

The hopper 12 has an upper end 26 and a lower end 28, the material receiving opening 14 being formed through the upper end 26. More particularly, the hopper 12 includes a first sidewall 30, an opposed second sidewall 32 (see FIG. 2), a first end wall 34 (see FIG. 2), an opposed second end wall 36, and a lower end wall 38. The walls 30, 32, 34, 36 and 38 are interconnected to encompass and form the hopper chamber 18.

A portion of the second end wall 36, extending a distance from the upper end 26 toward the lower end 28 of the hopper 18 is formed on an incline, the inclined portion of the wall 36 cooperating to move the material in the chamber 18 generally toward the lower end 28. The lower end wall 38 is formed on a radius and the material discharge opening 16 is formed through the lowermost portion of the lower end wall 38; that is, in the bottom of the chamber 18.

Figure 2:
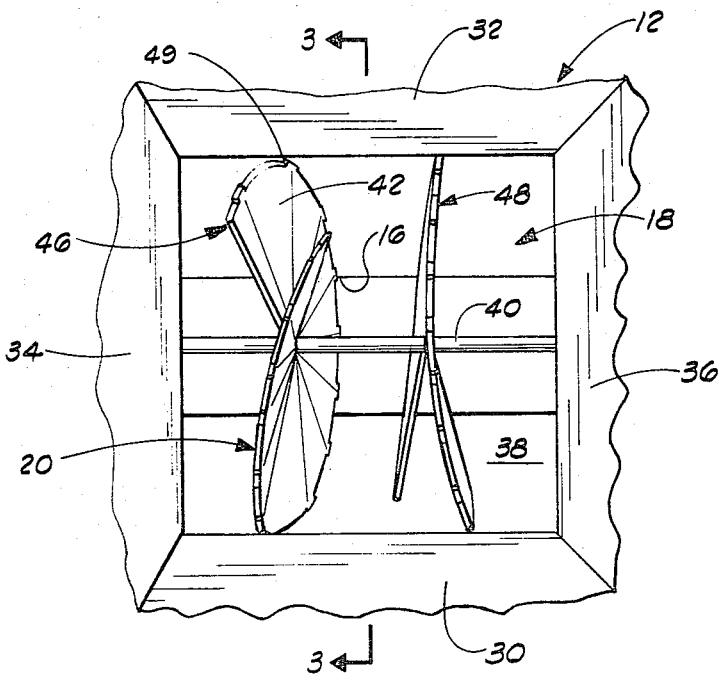
FIG. 2 is a partial plan view of the material moving apparatus illustrating the hopper blade assembly thereof.

Referring now to FIG. 2, the hopper blade assembly 20 includes a shaft 40, a plurality of blades 42 (only one blade 42 has been so designated in each of FIGS. 2 and 3) and a blade drive 44 (see FIG. 1). The shaft 40 is disposed in the hopper chamber 18 and extends generally between the first and the second end walls 34 and 36, respectively, the shaft 40 being rotatably mounted in the hopper 12 as will be discussed below. One end portion of the shaft 40 extends through the second end wall 36 and is connected to the blade drive 44, the blade drive 44 being mounted adjacent the end wall 36 as will be discussed below.

In one form, the blade drive 44 is an electric motor and, in an activated condition of the blade drive 44, the blade drive 44 operates to rotatingly drive the shaft 40 thereby rotating the blades 42. The blades 42 are disposed within the hopper chamber 18 and positioned to contact the material as the material falls through the chamber 18 generally from the upper end 26 toward the lower end 28. Further, the blades 42 are oriented and positioned on the shaft 40 to cooperate in moving the material from the chamber 18 through the material discharge opening 16.

Figure 3:
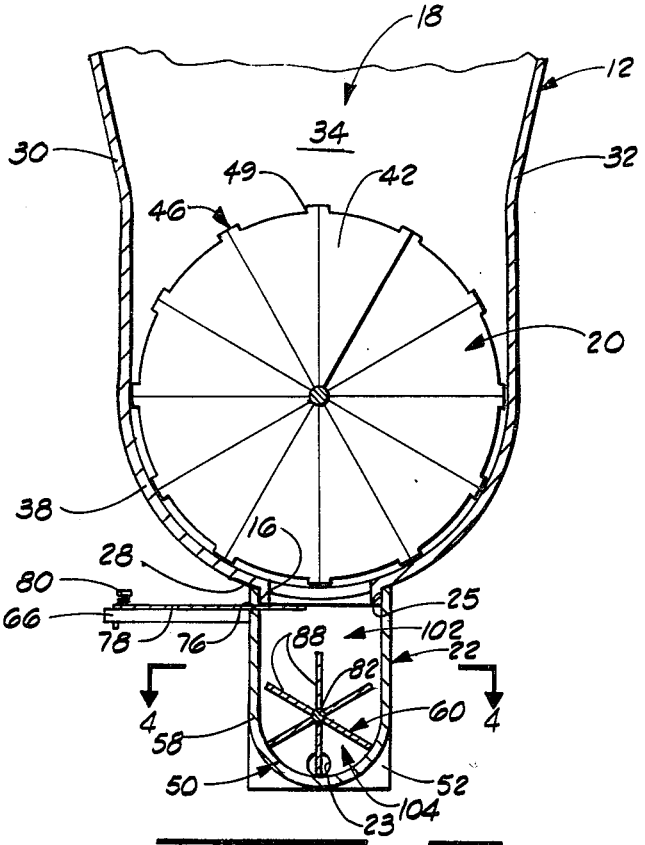
FIG. 3 is a partial cross-section in side elevation of the material moving apparatus taken substantially along line 3—3 of FIG. 1.

The hopper blade assembly 20, more particularly, includes: a first blade group 46, one end of each blade 42 of the first blade group 46 being connected to the shaft 40 and the blades 42 fanning out from the shaft 40 to form, in the composite, an auger-like structure; and a second blade group 48 similarly comprising a plurality of blades 42 each having one end connected to the shaft 40 and the blades 42 of the second blade group 48 extending radially from the shaft 40. As shown in FIGS. 2 and 3 the blade groups 46 and 48 have a unitary structure and are each constructed to form substantially one turn of a helical auger. Cutting edges for the blades 42, in such case, can be formed by means of notches, such as the notch 49 in FIG. 2, formed into the ends of the blades 42. As diagrammatically shown in FIG. 2, the first blade group 46 is positioned on the shaft 40 such that the first blade group 46 is disposed generally near the first end wall 34 of the hopper 12. The second blade group 48 is positioned on the shaft 40, spaced a distance from the first blade group 46 in a direction generally from the first end wall 34 toward the second end wall 36 such that the second blade group 48 is disposed generally near the second end wall 36.

Each of the blades 42 has a length sufficient such that the end of each of the blades 42, generally opposite the end which is connected to the shaft 40, is disposed near the lower end wall 38 during the rotation of the blades 42. In particular, the radius of curvature of the lower end wall 38 generally corresponds to the radius formed by each of the blades 42 extending from the shaft 40 to minimize the distance between the lower end wall 38 and the outermost ends of the blades 42, opposite the ends of the blades 42 connected to the shaft 40.

The first and second blade groups 46 and 48 cooperate in moving the material disposed in the hopper chamber 18 from the hopper chamber 18 and through central portions of the material discharge opening 16. More particularly, the disposition of the blade groups 46 and 48 near the end walls 34 and 36 and the close proximity of the outermost ends of the blades 42 to the curved end wall 38, in cooperation with the axial extent of the blade groups 46 and 48 on the shaft 40 resulting from the above described auger-like construction of the blade groups 46 and 48, results in material deposited in the hopper 12 being intercepted by the blade groups 46 and 48 so that such auger-like construction will tend to move such material parallel to the shaft 40. As indicated in FIG. 2, the pitches of the blade groups 46 and 48 have opposite senses and the shaft 40 is rotated in a direction to cause movement of material engaged by the blade groups 46, 48 away from the end walls 34, 36 near which the blade groups are disposed.

As an alternative to the above described hopper blade assembly 20, the material moving apparatus 10 can be provided with the hopper blade assembly described in my above-referenced U.S. Pat. application, Ser. No. 29,642 which is hereby incorporated by reference. In either case, the hopper blade assembly 20 will provide both a conveying function and a shredding function with the result that material within lower portions of the hopper 12 is maintained in a state of agitation prior to discharge of such material from the hopper 12. It has been found that such simultaneous conveyance and shredding of the material substantially eliminates a tendency of insulation material, which can be blown by the material moving apparatus 10, to bridge; that is, to form clumps which are undesirable when the material is used for insulation purposes.

Referring once again to FIG. 1, as indicated therein, lower portions of the end walls 34 and 36 of the hopper 12 are disposed in a generally parallel relation and the blower assembly 22 is mounted on the hopper 12 by means of such portion of the end walls. In particular, the blower assembly 22 comprises an air lock 50 having a first end plate 52 which bolts to the first end wall 34 of the hopper 12 and a second end plate 54 which similarly bolt to the second end wall 36 of the hopper 12. The end plates 52 and 54 of the air lock 50 provide a convenient means of mounting the hopper blade assembly 20 within the hopper 12. For this purpose, holes (not shown) are formed in the end walls 34 and 36 and the ends of the shaft 40 of the hopper blade assembly 20 pass through such holes to a bearing (not shown) on the first end plate 52 and to the blade drive 44 which is mounted on the second end plate 54. For this latter purpose, a section 56 of I-beam can be welded to the second end plate 54, the upper web of such section 56 forming a convenient mounting platform to which the blade drive 44 can be bolted.

The air lock 50 further comprises a body member 58 and a material transfer assembly 60 which will be discussed in more detail below with reference to FIGS. 3 and 4. For the present, it will suffice to note that the material transfer assembly 60 comprises a motor 62 which is mounted on the second end plate 54, the lower web of the section 56 of I-beam welded to the second end plate 54 providing a suitable platform for mounting, for example via bolts, the motor 62. Extending laterally from the body member 58 are three support members 64, 66, 68 for a purpose to be discussed below. As shown in FIG. 1, the central support member; that is, the support member 66, is provided with a plurality of holes extending vertically therethrough along the length of the support member 66.

Figure 4:
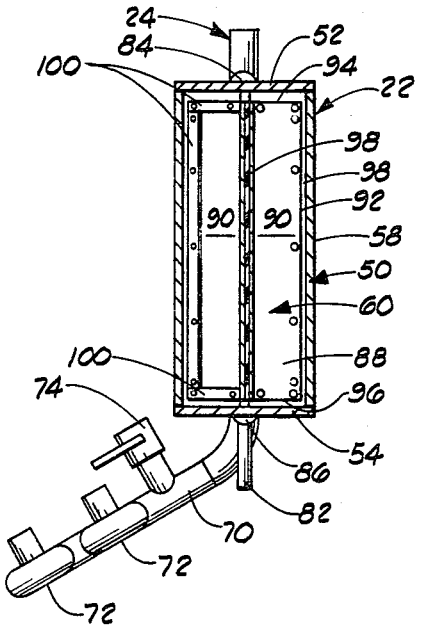
FIG. 4 is a plan view in partial cross-section of the blower assembly of the material moving apparatus taken alone line 4—4 of FIG. 3.

A hole (not shown) is formed through the second end plate 54, near the bottom edge thereof and a blower tube 70 is welded to the second end plate 54 about such hole so that air can be injected into the air lock 50 by means of conventional blowers 72 shown in FIG. 4. A valve 74 is connected to the blower tube 70 to permit a portion of the air supplied by the blowers 72 to be discharged from the blower tube 70 rather than injected into the air lock 50. The purpose of such discharge will be discussed below.

Referring now specifically to FIG. 3, the body member 58 has a U-shaped cross-section and the upper end thereof is disposed about portions of the hopper 12 wherein the discharge opening 16 thereof is formed so that material discharged from the hopper 12 is discharged into the air lock 50. A slot 76 is formed through the side of the body member 58 whereon the support members 64–68 are mounted, such slot extending between the end plates 52 and 54 of the air lock 50. The slot 76 is positioned immediately below the hopper 12 and generally level with the upper surfaces of the support members 64–68 so that a material discharge control plate 78, resting on the support members 64–68, can be partially inserted into the air lock 50 to control the flow of material from the hopper 12 into the air lock 50. A spring loaded pin 80 is mounted on the material discharge control plate 78, such pin 80 extending into one of the holes in the support member 66 to fix the portion of the material discharge control plate 78 that is inserted into the air lock 50.

The lower portion of the body member 58 has the general form of a circular semi-cylinder and the material transfer assembly 60 comprises a shaft 82 which extends through the body member 58 along the axis of the semi-cylindrical lower portion thereof. Holes (not shown) are formed in the end plates 52 and 54 and the ends of the shaft 82 pass through these holes and are supported by means of bearings 84 and 86 (FIG. 4) which are mounted on the end plates 52 and 54, respectively. As shown in FIG. 4, the end of the shaft 82 which is supported by the second end plate 54 is extended so that the motor 62 can be connected to the shaft 82 and utilized to rotate the shaft 82.

As shown in FIGS. 3 and 4, the material transfer assembly 60 comprises a plurality of vanes 88, the structure of the vanes 88 being particularly shown in FIG. 4. Each vane 88 comprises a rigid plate 90 which is welded to the shaft 82 and extends radially therefrom a distance slightly less than the radius of the semi-cylindrical portion of the body member 58 of air lock 50 such that the plate 90 terminates in a free edge 92 which is parallel to the axis of the shaft 82. Thus, as the shaft 82 is turned, the free edge 92 of each plate 90 sweeps out a cylindrical surface which is concentric with the semi-cylindrical portion of the body member 58 of air lock 50 and displaced radially inwardly therefrom. The length of each plate 90 is made slightly shorter than the distance between the end plates 52 and 54 of the air lock 50 and the plates 90 are positioned on the shaft 82 such that the ends 94, 96 thereof are spaced a distance from the end plates 52 and 54, respectively, as has been shown in FIG. 4. Each vane 88 further comprises a U-shaped wiper 98 which is constructed of a flexible material such as cloth-reinforced sheet rubber. Each wiper 98 is mounted on one of the plates 90 to extend from the ends 94, 96 and edge 92 thereof so as to engage the end plates 52 and 54 and, at such times that the shaft 82 is turned to position the vane below the shaft 82, the semi-cylindrical portion of the body member 58 of the air lock 50. The wipers 98 can be conveniently secured to the plates 90 via metal straps 100 which are riveted to the plates 90 with portions of the wipers 98 sandwiched between the straps 100 and the plates 90.

As schematically indicated in FIG. 3, the vanes 88 (for clarity of illustration, the structure of the vanes 88 has not been shown in FIG. 3) thus divide the air lock 50 into an upper, or inlet, chamber 102 disposed immediately below and in communication with the hopper material discharge opening 16 and a lower, or outlet, chamber 104 wherein the blower discharge 23 is formed, the outlet chamber 104 further being in communication with the blower tube 70 so that air forced through the air lock 50 by the blowers 72 passes through the outlet chamber 104 thereof. The material of which the wipers 98 are constructed is chosen such that the wipers 98 form a hermetic seal between the inlet chamber 102 and the outlet chamber 104 to channel the output of the blowers 72 through the outlet chamber 104 while permitting material discharged from the hopper 12 to be introduced into the outlet chamber 104 by turning the vanes 88 via the motor 62.

OPERATION OF THE PREFERRED EMBODIMENT

During the operation of the material moving apparatus 10, material such as insulation is loaded into the chamber 18 via the material receiving opening 14, the material moving downwardly through the chamber 18 generally from the upper end 26 toward the lower end 28 of the hopper 12. As material passes through the chamber 18, the material is contacted by the rotating blades 42 whereby the material is shredded to the desired material density or size. The material is moved via the auger-like shaping of the blade groups 46, 48 of the hopper blade assembly 20 from the chamber 18 into and through central portions of the material discharge opening 16, the material being passed from the material discharge opening 16 into the inlet chamber 102 of the air lock 50. Rotation of the vanes 88 of the material transfer assembly 60, by the motor 62, then transfers the material from the inlet chamber 102 to the outlet chamber 104 of the air lock 50. Air blown into the outlet chamber 104, as described above, then forcibly discharges the material from the blower assembly 22 via the blower discharge into and through the discharge conduit 24. The material is discharged from the material moving apparatus 10 via the discharge conduit 24. In an operational application, an additional conduit is connected to the discharge conduit 24 to receive the material discharged from the material moving apparatus 10 for blowing the material into the desired location by positioning such additional flexible conduit (not shown).

At times, during the operation of the material moving apparatus 10, it will be desirable to limit the quantity of material discharged into the blower assembly 22, or the flow of air through the air lock 50, or both. The material discharge control plate 78 and the valve 74 are provided for this purpose. In particular, the quantity of material discharged from the material discharge opening 16 can be varied by inserting the material discharge control plate 78 partially through the slot 76 to occlude a portion of the material discharge opening 16. The quantity of air passing through the air lock 50 is similarly controlled by partially opening the valve 74 to bleed air from the blower tube 70 so as to reduce the pressure of air entering the air lock 50.

As mentioned above, the material moving apparatus 10 is particularly useful for blowing insulation into portions of various structures. Thus, all of the components of the material moving apparatus 10 are contained within a framework 108, as shown in FIG. 1, so that the material moving apparatus 10 can be easily transported to various remote locations. The framework 108 can be installed in a pickup truck or a truck-van type of vehicle thereby providing the required mobility of the material moving apparatus 10.

The blades 42, forming the blade groups 46 and 48, must be of a sufficient length to cut the insulation material in the hopper chamber 18 and to keep the material within the chamber 18 agitated, thereby substantially preventing the insulation material from bridging. The hopper 12 is designed such that the first and second side walls 30 and 32 and the first end wall 34 are substantially straight and these straight walls 30, 32 and 34 cooperate with the curved or rounded bottom of the hopper 12 to substantially eliminate bridging problems when utilizing the material moving apparatus 10 for blowing insulation type materials.

The material moving apparatus 10 is designed to substantially reduce the number of moving parts and to eliminate belts, pulleys, chains or sprockets, thereby reducing maintenance and repair or replacement expense.

The material moving apparatus 10 has only two moving parts, the blower assembly 22 and the hopper blade assembly 24, thereby reducing maintenance and repair problems. In this regard, it will be noted that the construction of the blower assembly 22 to include the second end plate 54 whereon the motors 44 and 62 are mounted and the disposition of the air lock 50 beneath the hopper 12 facilitates repair and maintenance by forming the blower assembly 22 into an integral unit which may be detached from the hopper 12 for repair purposes.

Utilizing the material moving apparatus 10 of the present invention, the insulation material is shredded as the insulation material is conveyed via the auger action of the hopper blade assembly 20. The blades 42 of the hopper blade assembly 20 cooperate or act to reduce "clumps" in the insulation material while the material is being conveyed.

Changes may be made in the construction and operation of the various elements and assemblies described herein without departing from the spirit and the scope of the invention as defined in the following claims.

What is claimed is:

1. A material moving apparatus, comprising:

a hopper having an upper end and a lower end, a material receiving opening being formed in the upper end, the hopper having a chamber and a material discharge opening, material being dischargeable into the chamber through the material receiving opening and the material being movable from the chamber through the material discharge opening, the lower end portion of the hopper being formed on a radius;

a hopper blade assembly disposed in the hopper chamber for shredding the material discharged into the hopper chamber, the hopper blade assembly cooperating to shred the material and cooperating to move the material from the hopper chamber through the material discharge opening, comprising:

a shaft rotatably mounted and extending through a portion of the hopper chamber;

at least two blades, each blade being connected to the shaft and extending a distance radially therefrom terminating with an outermost end; and means to rotatingly drive the shaft, thereby rotating the blades within the hopper chamber, the lower end portion of the hopper being formed on the radius and shaped to provide a minimum clearance between the outermost ends of the blades of the hopper blade assembly and the lower end portion of the hopper;

a blower assembly receiving the material discharged through the hopper material discharge opening and forcibly discharging the received material through a blower discharge, the blower assembly comprising:

an air lock having an inlet chamber communicating with the hopper material discharge opening; an outlet chamber wherein the blower discharge is formed; and means, forming a substantially hermetic seal between the inlet and outlet chambers of the air lock, for transferring material received in the inlet chamber to the outlet chamber; and means for injecting air into the outlet chamber of the airlock; and;

a discharge conduit connected to the blower discharge and receiving the material discharged from the material discharge opening, the material being discharged from the material moving apparatus via the discharge conduit.

2. The apparatus of claim 1 wherein the hopper blade assembly comprises a plurality of blades organized into a first blade group forming substantially one turn of a helical auger and a plurality of blades organized into a second blade group similarly organized into substantially one turn of a helical auger.

3. The apparatus of claim 1 or claim 2 further comprising means for partially occluding the hopper material discharge opening.

4. The apparatus of claim 3 wherein the air lock is characterized as comprising:

a first end plate;

a second end plate spaced a distance from the first end plate and substantially parallel thereto; and a U-shaped body member connected to the end plates and extending therebetween such that the open end of the U-shaped body member forms an inlet of the blower assembly;

wherein a slot is formed in one side of the body member; and wherein the means for partially occluding the material discharge opening is characterized as comprising a material discharge control plate insertable through said slot in the side of the body member of the air lock.

5. The apparatus of claim 4 wherein the means for injecting air into the outlet chamber of the air lock comprises a blower tube communicating with the outlet chamber of the air lock and means for blowing air into the blower tube; and wherein the blower assembly further comprises a valve connected to the blower tube for discharging a portion of the air blown thereinto.

6. The apparatus of claim 1 wherein the means for injecting air into the outlet chamber of the air lock comprises a blower tube communicating with the outlet chamber of the air lock and means for blowing air into the blower tube; and wherein the blower assembly further comprises a valve connected to the blower tube for discharging a portion of the air blown thereinto.

* * * * *